US008881408B2

(12) United States Patent
Martinsson et al.

(10) Patent No.: US 8,881,408 B2
(45) Date of Patent: Nov. 11, 2014

(54) JOINT PROTECTING MEMBER FOR COMBINED FUEL AND HANDLE UNIT

(75) Inventors: Pär Martinsson, Jönköping (SE); Stefan Kullberg, Jönköping (SE)

(73) Assignee: Husqvarna AB, Huskvarna (SE)

( * ) Notice: Subject to any disclaimer, the term of this patent is extended or adjusted under 35 U.S.C. 154(b) by 933 days.

(21) Appl. No.: 12/963,499

(22) Filed: Dec. 8, 2010

(65) Prior Publication Data

US 2011/0072670 A1 Mar. 31, 2011

Related U.S. Application Data

(63) Continuation of application No. 12/343,349, filed on Dec. 23, 2008, now abandoned, which is a continuation of application No. PCT/SE2006/000775, filed on Jun. 26, 2006.

(51) Int. Cl.
*B27B 17/00* (2006.01)
*B25G 1/10* (2006.01)

(52) U.S. Cl.
CPC ..... *B25G 1/10* (2013.01); *B27B 17/0008* (2013.01)
USPC ..... 30/381; 30/517

(58) Field of Classification Search
USPC ..... 30/381–387, 514, 517
See application file for complete search history.

(56) References Cited

U.S. PATENT DOCUMENTS

| | | | | | |
|---|---|---|---|---|---|
| 2,444,138 | A | * | 6/1948 | Mall | 30/386 |
| 3,157,211 | A | * | 11/1964 | Wiig | 30/386 |
| 4,389,779 | A | | 6/1983 | Overbury et al. | |
| 4,761,939 | A | | 8/1988 | Zerrer | |
| 4,785,540 | A | | 11/1988 | Arvidsson | |
| 4,946,087 | A | | 8/1990 | Wingert | |
| 4,964,217 | A | | 10/1990 | Siede et al. | |
| 4,969,270 | A | | 11/1990 | Berghauser et al. | |
| 5,029,393 | A | * | 7/1991 | Nagashima et al. | 30/383 |
| 5,215,049 | A | | 6/1993 | Wolf | |
| 5,542,380 | A | * | 8/1996 | Chatten | 123/41.7 |
| 5,580,636 | A | | 12/1996 | Kampmann et al. | |
| 5,960,549 | A | | 10/1999 | Hoppner | |
| 6,016,604 | A | * | 1/2000 | Wolf et al. | 30/383 |

(Continued)

FOREIGN PATENT DOCUMENTS

WO 2004037494 A1 5/2004

OTHER PUBLICATIONS

International Search Report for corresponding International Application No. PCT/SE2006/000775, dated Jan. 15, 2007, 3 pages.

*Primary Examiner* — Stephen Choi
(74) *Attorney, Agent, or Firm* — Novak Druce Connolly Bove & Quigg, LLP

(57) ABSTRACT

A combined fuel tank and handle unit for a motorized, hand-held tool includes a substantially closed volume, a handle, and a joint between two parts of the unit. The joint protrudes a distance beyond the surrounding surfaces. At least one rib is disposed at a distance from the joint on the underside of the tool.

18 Claims, 3 Drawing Sheets

(56) References Cited

U.S. PATENT DOCUMENTS

| | | | | |
|---|---|---|---|---|
| 6,192,840 | B1 * | 2/2001 | Durr et al. | 123/41.65 |
| 6,973,726 | B2 * | 12/2005 | Kramer | 30/216 |
| 7,204,025 | B2 | 4/2007 | Ziegs et al. | |
| 7,374,823 | B2 | 5/2008 | Maruyama et al. | |
| 2002/0081148 | A1 | 6/2002 | Ezumi et al. | |
| 2004/0169062 | A1 | 9/2004 | Maruyama et al. | |
| 2004/0172834 | A1 | 9/2004 | Ziegs et al. | |
| 2005/0115340 | A1 | 6/2005 | Sasaki et al. | |

* cited by examiner

JOINT PROTECTING MEMBER FOR COMBINED FUEL AND HANDLE UNIT

CROSS-REFERENCE TO RELATED APPLICATIONS

The present application is a continuation of U.S. application Ser. No. 12/343,349, filed on Dec. 23, 2008, which is a continuation of International Application No. PCT/SE2006/000775, filed on Jun. 26, 2006, which was published in English pursuant to Article 21(2) of the Patent Cooperation Treaty as WO 2008/002203, said applications are incorporated herein by reference in their entirety.

TECHNICAL FIELD

The present disclosure relates to a handle member for a motorized, handheld tool including at least one substantially closed volume, a handle and a joint between two parts of the handle member, wherein the joint protrudes a distance beyond the surrounding surfaces.

BACKGROUND

Many handheld tools, such as chain saws, employ the two-mass principle, wherein the handle or handles and the fuel tank are separated from the engine. Springs suspending the engine base on a handle member greatly reduce vibrations in the handle or handles providing better working conditions for a user.

The engine base includes the engine with its movable parts, a centrifugal clutch to the chain, a chain brake and a kickback guard. The handle member includes a front and a rear handle, as well as a fuel tank.

The rear handle is in general formed integrally with the fuel tank in the handle member, preferably from a plastics material. The handle member can be manufactured by injection molding in two separate parts, which are not necessarily identical, but which are intended to be joined together along a circumferential line. The method of joining the two parts of the handle member is in general vibration welding, which includes a series of vibrations with a high frequency and a low amplitude, resulting in a joint along the circumferential line.

Since vibration welding of two pieces requires a sufficient thickness of the material to be welded, the walls of the handle member in several places have a greater thickness in the area of the joint. This will in turn mean that the weld will in several places be located at a protuberance, extending a distance from the surrounding surfaces. Especially on the underside of the handle member, this means that there is a protruding ridge, the weld, along the underside of the handle member, i.e. on the underside of the tool. When placing the tool on the ground this often means that the tool does not stand in a steady position but tends to lean over towards one side or the other. When cutting branches with a chain saw, the underside of the handle unit will sometimes be pushed over logs and branches. This tends to dirty and scratch the underside of the tool thereby impairing its appearance. These problems may be alleviated with embodiments of the disclosed handle member.

SUMMARY

The handle member is characterized in that at least one rib is disposed at a distance from the joint on the underside of the handle member. Preferably the rib/ribs runs in a longitudinal direction. This has the further advantage of steering the tool in a longitudinal direction when pushed over a log or branch.

BRIEF DESCRIPTION OF THE ACCOMPANYING DRAWINGS

Embodiments of the present disclosure will now be described in greater detail below, with particular reference to the accompanying drawings. In the accompanying drawings.

DETAILED DESCRIPTION

In the following description, words and expressions such as underside, bottom and the like are used. These words should be interpreted as referring to the chain saw in a normal position of use and storage, such as the position illustrated in FIG. 1.

Figure 1:
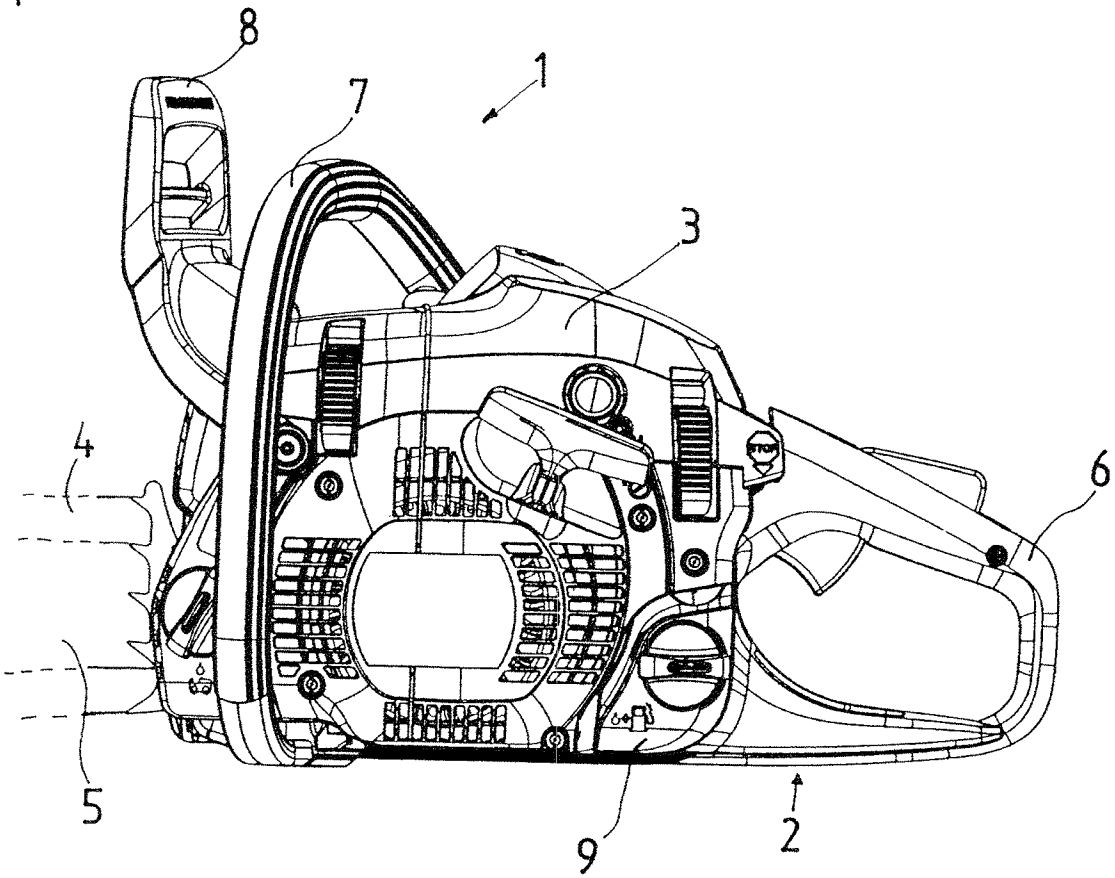
FIG. 1 is an illustrative side view of a chain saw with a handle member according to one embodiment.

In FIG. 1 a chain saw 1 including a handle member 2 according to one embodiment is shown. An engine base 3 includes an engine, which is connected to a chain 4 on a bar 5. The handle member 2 includes a rear handle 6, which typically is integral with a fuel tank 9. A front handle 7 is supported on the handle member 2, and the handle member 2 and the engine base 3 can be joined together in a manner previously known in the art. Various safety features, such as a kickback guard 8 are also known from the state of the art.

Figure 2:
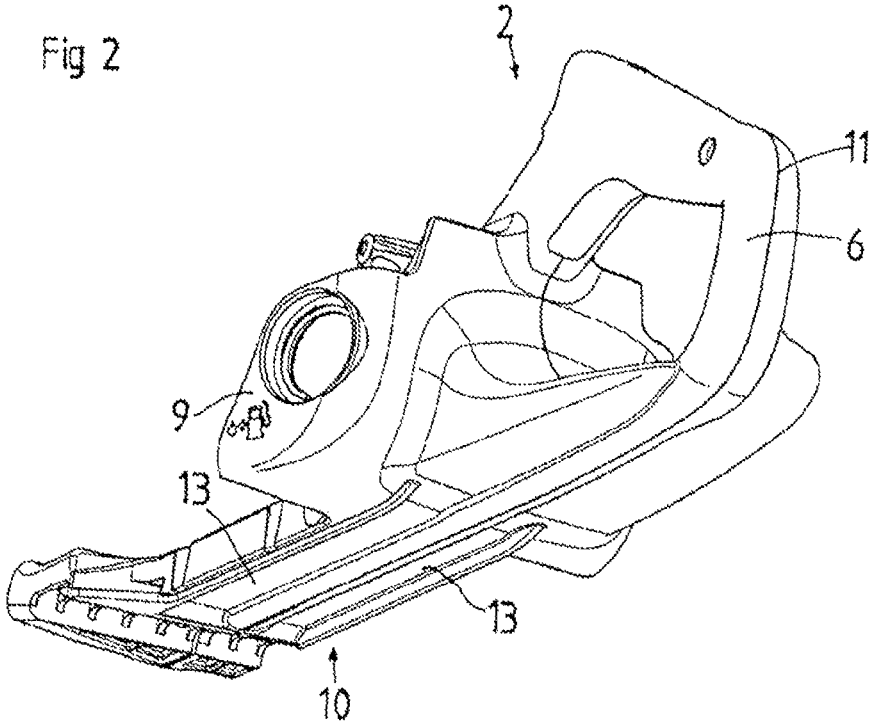
FIG. 2 is an illustrative perspective view of the handle member according to one embodiment.

FIG. 2 displays the handle member 2 in a perspective view from below. Here, it is clearly visible that the rear handle 6 is integrally formed with the fuel tank 9. A bridge portion 10 extends in the forward direction to support the front handle 7, which is not shown in this drawing. Also, the engine base 3 would be placed above the bridge portion 10 in the complete chain saw 1.

The handle member 2 can be manufactured from a plastics material in two pieces by injection molding. The two pieces can be joined together by vibration welding at a joint 11. The joint 11 extends circumferentially around the handle member 2. As the vibration welding requires a certain minimum wall thickness in the region of the joint 11, and the wall thickness in the handle member 2 is generally smaller than the wall thickness required for welding, the joint 11 protrudes a distance beyond the surrounding surfaces 13, at least in areas where the surrounding surfaces 13 are planar, e.g. at the underside of the bridge portion 10.

Figure 4:
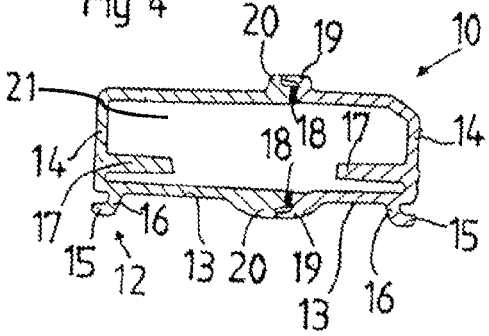
FIG. 4 is an illustration of a section along the line A-A in FIG. 3.

As illustrated in FIG. 4, the joint 11 can have a particular structure which contributes to its protrusion beyond its surrounding surfaces 13. During the vibration welding, the weld 18 will be formed between two surfaces in contact. Excess material may flow to the sides thereof. In order to maintain a unitary and snug appearance, two protecting members 19, 20 extend over and beyond the weld 18, forming an open space between themselves and the weld 18 for any excess material. All in all, the joint with its weld 18 and protecting members 19, 20 protrude beyond the surrounding surfaces 13.

On either side of the joint 11, protruding ribs 12 are provided at the bottom of the handle member 2. This is also clear from FIG. 3. Each rib 12 protrudes a distance from the adjacent bottom wall 13 of the handle member 2. The ribs 12, which are two in number in the preferred embodiment, protrude at least as far as the joint 11. Thus, the bottom wall 13 is recessed in relation to the furthest protruding parts of the joint 11 and the ribs 12.

The ribs 12 are preferably placed on both sides of the joint 11 in the preferred embodiment. However, the distances from the respective ones of the ribs 12 to the joint 11 need not be exactly the same, depending on the width of the bridge portion 10 and the positioning of the joint 11 thereon. The positioning of the joint in the bridge portion 10, and in the handle member 2 as a whole, depends mainly on manufacturing considerations.

The ribs 12 are arranged wholly or at least partially beneath the closed volume 21 or volumes. Thus, not only the fuel tank 9 could be provided with ribs on its outside, but also the underside of the rear handle. In most cases, there is an internal wall between the rear handle 6 and the fuel tank 9, as well as an internal wall in the bridge portion 10 that separates part of it from the fuel tank.

In order to attain maximum beneficial effects from the ribs 12, they are preferably positioned as far apart as possible on the outside edge of bridge portion 10, giving it a maximum torsion resistance, as well as protecting the entire underside from scratches and wear. The ribs also increase the bending resistance of the bridge portion 10.

Although the beneficial effect from arranging ribs 12, which protrude at least as far as the joint 11, is independent of the direction of extension of the ribs 12, they are arranged in the longitudinal direction of the bridge portion 10 in the preferred embodiment. The reason for this is twofold. Firstly, the manufacture of the two parts of the handle member 2 will be as simple as possible. Secondly, when the joint 11 and the ribs 12 extend in the same direction, the underside of the handle member 2 will be free from small recesses and enclosures, which may collect dirt or catch onto twigs or irregularities in the tree's surfaces over which it passes.

The provision of two ribs alongside of each other will also greatly contribute to the stability of the chain saw 1 when it is placed on a planar surface, and keep it from falling over sideways, thus enhancing the handability, which may be of importance to a prospective buyer of the saw.

Figure 3:
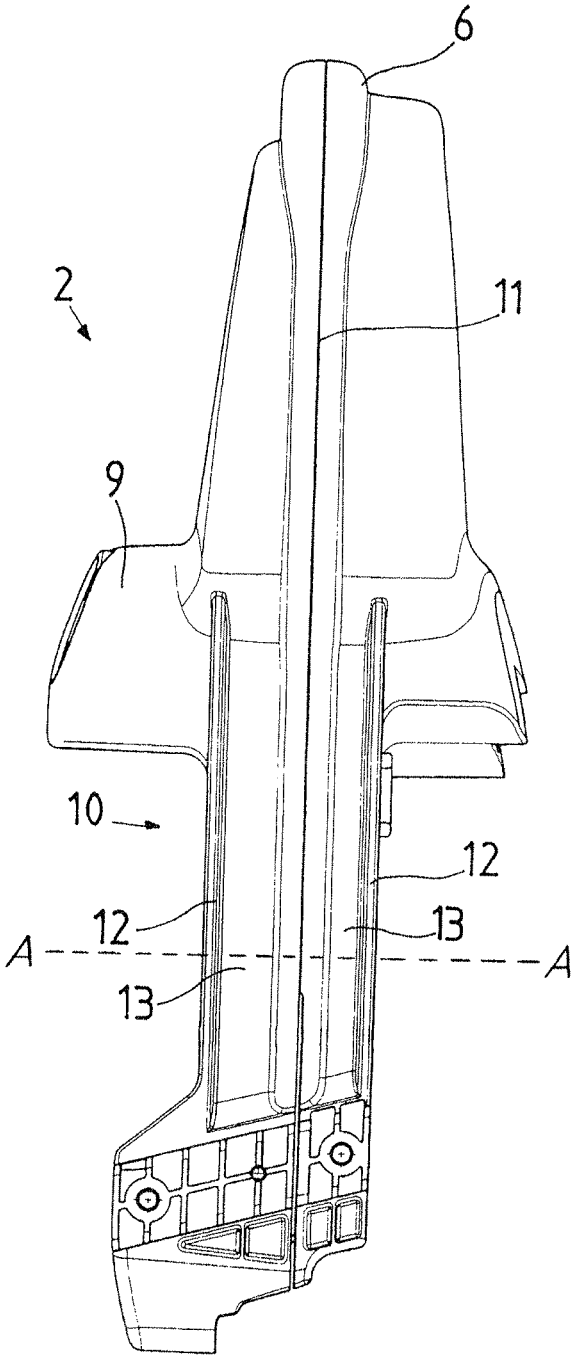
FIG. 3 is an illustrative bottom view of the handle member according to one embodiment.

A cross-sectional view in FIG. 4, taken along the line A-A of FIG. 3, provides details concerning the shape and location of the ribs 12. Also in FIG. 4, the thickness of material in the area of the joint 11 is shown clearly. The ribs 12 protrude from the surface 13 at the underside of the bridge portion 10 at least as far as the joint 11. Likewise, the ribs 12 are positioned as far apart as the width of the bridge portion 10 will allow, without increasing the total outer dimensions of the bridge portion 10. This results in the ribs 12 being placed in the vicinity of each of the side walls 14 in the bridge portion 10, without extending significantly outside of the side walls 14. Therefore, when the saw rests on a surface, it will be stabilized by the ribs because the ribs extend at least as far from the underside of the saw as any other part of the saw. In addition to stabilizing the saw, the ribs protect other surfaces of the underside of the saw from scratches and other damage when performing tasks that require the bottom of the saw to come into contact with another surface, such as when saw comes into contact with the trunk of a tree while cutting the tree.

To make the ribs 12 as durable as possible, since they will be exposed to a major part of the wear when the chain saw 1 is pushed over logs or branches, the ribs 12 can have a wide support surface 15. At the same time, the thickness of material in the handle member 2 as a whole should preferably be as homogeneous as possible. In order to fulfill these two requirements, the ribs 12 have, in one embodiment, been given the cross-sectional shape shown in FIG. 4. The support surfaces 15 extend along the bottom wall 13 at a distance therefrom forming a lower portion at each rib 12, while an upper portion, a perpendicular wall 16, extends between the bottom wall 13 and each support surface 15, such that a rib 12 with a hook-like cross-section is formed. The bottom wall 13, the side walls 14, the support surfaces 15, and the perpendicular wall 16 preferably all have the same thickness of material. The support surface 15 in each rib 12 is wider than the thickness of material forming each rib 12. Each rib can also be lined with a harder material, e.g. stainless steel. The rib 12 can also be formed so as to produce the T-shape illustrated in FIG. 5. Such ribs can have excellent resistance against scratching and wear.

An interior rib 17 extends from each side wall 14. The interior rib 17 can increase the stiffness of the bridge portion 10.

Figure 5:
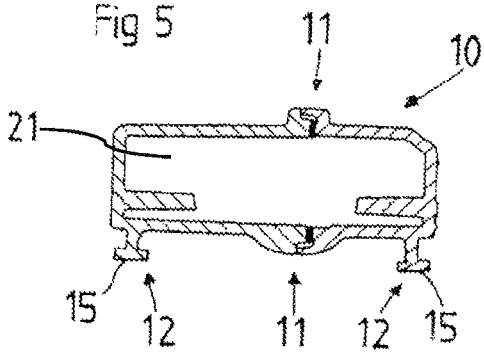
FIG. 5 is an illustrative view according to FIG. 4 of an alternative embodiment.

In other embodiments, the shape of the ribs 12 could of course be varied, as could the positioning thereof. FIG. 5 shows an alternative embodiment where the cross-sectional shape of the rib 12 is different from that of FIG. 4. One important thing to consider for the choice of the shape of the ribs 12 is keeping the thickness of material as homogeneous as possible. Secondly, the ease of manufacture will also affect the choice of a suitable rib shape. Shapes that require a less complicated molding tool can be preferred.

If needed, the ribs 12 could be positioned at a smaller distance from each other and from the joint 11. The length of the ribs may be varied, and there can also be one or more interruptions, i.e., instead of one long rib 12, there are a series of several shorter ribs 12 arranged along a line.

Although the ribs 12 are substantially parallel have been generally described as being substantially parallel above, there can be applications where the ribs 12 are disposed at an angle with respect to the joint 11 that can be desirable.

The present disclosure may be modified and varied further without departing from the scope of the appended claims.

The invention claimed is:

1. A combined fuel tank and handle unit for a motorized, handheld tool, comprising:

at least one handle;

at least one substantially closed volume formed by two parts of the unit joined together, a protruding joint formed by the two parts of the unit, wherein the protruding joint extends longitudinally on an underside of the tool and protrudes a distance beyond surrounding surfaces of the underside of the tool; and at least one rib disposed on each side of the protruding joint at a distance from the joint, the at least one rib extending longitudinally on the underside of the tool and protruding a distance beyond surrounding surfaces of the underside of the tool, wherein the at least one rib protrudes outside of surfaces surrounding the joint, an amount at least equal to the distance that the joint protrudes beyond the underside of the tool, such that the at least one rib is configured to contact a log, wherein the protruding joint and the at least one rib form a recess in relation to a furthest protruding portion of the protruding joint and the at least one rib.

2. The combined fuel tank and handle unit according to claim 1, wherein the at least one closed volume includes wall portions, and the at least one rib is extending along one of the wall portions.

3. The combined fuel tank and handle unit according claim 1, wherein the at least one rib is arranged such that main parts of surfaces surrounding the joint are recessed in relation to the at least one rib.

4. The combined fuel tank and handle unit according to claim 1, wherein the at least one substantially closed volume is a fuel tank, and the at least one rib extends in a longitudinal direction across a portion of the fuel tank.

5. The combined fuel tank and handle unit according to claim 4, wherein the at least one rib extends in a longitudinal direction beyond the fuel tank.

6. The combined fuel tank and handle unit according to claim 1, wherein the at least one rib is disposed along the joint at a substantially constant distance there from.

7. The combined fuel tank and handle unit according to claim 1, wherein the at least one rib comprises at least two ribs which are placed on either side of the joint.

8. The combined fuel tank and handle unit according to claim 1, wherein the at least one rib has a downwardly facing support surface, which is wider than a thickness of a material of the at least one rib.

9. The combined fuel tank and handle unit according to claim 1, wherein the at least one rib has a substantially homogeneous thickness of material.

10. The combined fuel tank and handle unit according to claim 9, wherein the rib has an upper portion extending away from the underside of the tool and a lower portion essentially parallel with the underside of the tool.

11. The combined fuel tank and handle unit according to claim 1, wherein the handheld tool is a chain saw.

12. A combined fuel tank and handle unit of a handheld tool, the unit comprising:

a first half;

a second half; wherein the first half and the second half forming the combined fuel tank and handle unit a protruding joint formed by the first and second halves and extending longitudinally on the underside of the handheld tool, wherein the protruding joint extends beyond surrounding surfaces; and a plurality of ribs arranged adjacent to, and on opposite sides of the joint, wherein the plurality of ribs extend from the underside of the handheld tool in a direction that is the same as that of a direction in which the joint extends, wherein the at least one rib protrudes outside of surfaces surrounding the joint, an amount at least equal to the distance that the joint protrudes beyond the underside of the tool, such that the at least one rib is configured to contact a log, wherein the protruding joint and the plurality of ribs form a recess in relation to a furthest protruding portion of the protruding joint and the plurality of ribs.

13. The combined fuel tank and handle unit according to claim 12, wherein the joint protrudes from the underside of the handheld tool.

14. The combined fuel tank and handle unit according to claim 12, wherein the plurality of ribs extend from the outer edges of the underside of the handheld tool.

15. The combined fuel tank and handle unit according to claim 12, wherein the plurality of ribs have a substantially homogeneous thickness of material.

16. The combined fuel tank and handle unit of claim 12, wherein the first half and the second half form at least one substantially closed volume which is a fuel tank, and the at least one rib extends in a longitudinal direction across a portion of the fuel tank.

17. The combined fuel tank and handle unit of claim 16, wherein the at least one rib extends in a longitudinal direction beyond the fuel tank.

18. A handheld tool comprising:

a combined fuel tank and handle unit comprising two halves;

a protruding joint formed by the two halves and extending longitudinally on an underside of the handheld tool, wherein the protruding joint extends beyond surrounding surfaces;

at least one rib running in a longitudinal direction on each of the halves of the unit such that the at least one rib is disposed on each side of the protruding joint, wherein the at least one rib protrudes outside of surfaces surrounding the joint, an amount at least equal to the distance that the joint protrudes beyond the underside of the tool, such that the at least one rib is configured to contact a log, wherein the ribs extend from the underside of the handheld tool and are separated from each other by a distance, whereby when the tool is supported by the ribs, the tool is stable; and each of the ribs further comprising a support surface, whereby the support surface supports the handheld tool when the handheld tool is supported from the support surface, whereby portions of the underside of the handheld tool are protected from contacting a surface which the support surfaces of the ribs are in contact with, wherein the protruding joint and the ribs form a recess in relation to a furthest protruding portion of the protruding joint and the ribs.

* * * * *